US010837230B1

(12) United States Patent
Curtis

(10) Patent No.: US 10,837,230 B1
(45) Date of Patent: Nov. 17, 2020

(54) LADDER HOOP

(71) Applicant: Johnny Curtis, Denham Springs, LA (US)

(72) Inventor: Johnny Curtis, Denham Springs, LA (US)

( * ) Notice: Subject to any disclaimer, the term of this patent is extended or adjusted under 35 U.S.C. 154(b) by 0 days.

(21) Appl. No.: 15/662,957

(22) Filed: Jul. 28, 2017

Related U.S. Application Data

(60) Provisional application No. 62/368,680, filed on Jul. 29, 2016.

(51) Int. Cl.
*E06C 7/18* (2006.01)
*E04G 5/10* (2006.01)

(52) U.S. Cl.
CPC ..... *E06C 7/185* (2013.01); *E04G 5/10* (2013.01)

(58) Field of Classification Search
CPC ... E06C 1/34; E06C 7/185; E06C 7/20; E06C 7/22; E06C 7/08; E06C 7/10; E06C 7/12; E06C 7/14; E06C 7/24; E06C 7/26; E06C 7/50
See application file for complete search history.

(56) References Cited

U.S. PATENT DOCUMENTS 1,706,215 A * 3/1929 Davidson ..... E04G 7/16 403/97
2,107,407 A * 2/1938 Burton ..... E04G 7/12 403/385
2,476,863 A * 7/1949 Hawes ..... E04G 7/24 403/395
2,716,576 A * 8/1955 Nordone ..... E04G 7/305 403/49
2,726,902 A * 12/1955 Borgman ..... E04G 7/305 403/49
2,808,298 A * 10/1957 Meng ..... E04G 7/305 403/49
2,849,258 A * 8/1958 Crook ..... E04G 7/305 403/49
2,891,820 A * 6/1959 Schoeneberg ..... E04G 7/305 403/376
RE25,053 E * 10/1961 Juculano ..... E04G 7/304 403/49
3,017,208 A * 1/1962 Wyse ..... E04G 7/305 403/49
3,054,630 A * 9/1962 French ..... E04G 7/305 403/368
3,122,385 A * 2/1964 Levizzani ..... E04G 7/305 403/49
3,266,208 A * 8/1966 Maggs ..... E04G 1/15 52/651.1
3,360,287 A * 12/1967 Wyse ..... E04G 7/305 403/217
3,458,222 A * 7/1969 Juculano ..... E04G 7/305 403/49

(Continued)

*Primary Examiner* — Katherine W Mitchell
*Assistant Examiner* — Shiref M Mekhaeil
(74) *Attorney, Agent, or Firm* — Intellectual Property Consulting, LLC; Bernard Meroney

(57) ABSTRACT

A ladder hoop having a hoop shaped member with an inner facing surface, an outer facing surface, a top and a bottom. The hoop has two terminating ends forming an opening there between, and each terminating end is adapted to attach to a scaffold ladder. The hoop includes tabs supporting a member movable on the tabs between an open position and a closed position.

4 Claims, 16 Drawing Sheets

CLOSED POSITION

(56) References Cited

U.S. PATENT DOCUMENTS 3,647,250 A * 3/1972 Brown ..... E05C 5/00 292/67
3,730,572 A * 5/1973 Ballou ..... E04G 1/14 403/49
3,807,884 A * 4/1974 Juculano ..... E04G 7/307 403/49
3,867,043 A * 2/1975 Plough ..... E04G 5/16 403/49
4,089,084 A * 5/1978 Droz ..... A47C 4/32 16/357
4,111,579 A * 9/1978 Knight ..... E04G 7/18 182/186.8
4,140,414 A * 2/1979 Buttgereit ..... A47B 57/50 403/71
4,462,197 A * 7/1984 D'Alessio ..... E04G 1/12 182/178.5
4,493,394 A * 1/1985 Karlsen ..... E04G 7/305 182/186.8
4,514,940 A * 5/1985 Manderla ..... E04G 1/12 182/186.8
4,566,819 A * 1/1986 Johnston ..... E04G 7/14 403/385
4,630,956 A * 12/1986 Gilbreath ..... E04G 5/16 29/453
4,841,708 A * 6/1989 Johnston ..... E04G 1/12 249/18
5,040,916 A * 8/1991 Morgan ..... E04G 7/26 403/387
5,186,568 A * 2/1993 Falardeau ..... E04G 7/305 182/186.8
5,367,852 A * 11/1994 Masuda ..... E04G 1/06 52/651.06
5,427,465 A * 6/1995 Sato ..... E04G 7/16 403/49
5,555,954 A * 9/1996 Swiderski ..... E04G 1/34 182/119
6,039,150 A * 3/2000 Palmer ..... E04G 3/26 182/113
6,305,868 B1 * 10/2001 Kinoshita ..... E04G 7/305 403/196
6,899,201 B2 * 5/2005 Thiessen ..... E04G 5/10 182/106
6,929,094 B1 * 8/2005 Kohlmeier ..... E06C 7/185 182/106
7,448,819 B1 * 11/2008 Fu ..... E04G 7/16 403/49
7,942,027 B1 * 5/2011 Cassini ..... E05B 13/004 292/100
7,975,803 B2 * 7/2011 Schwoerer ..... E04G 1/15 182/178.1
8,104,579 B1 * 1/2012 Fu ..... E04G 1/12 182/186.8
9,808,929 B2 * 11/2017 Bukovitz ..... B25G 1/06
2005/0189172 A1 * 9/2005 Becker ..... E04G 5/10 182/106
2006/0054396 A1 * 3/2006 Stringer ..... E04G 7/307 182/186.8
2007/0151801 A1 * 7/2007 Talley ..... E06C 7/185 182/106
2008/0203040 A1 * 8/2008 Kologe ..... A47F 5/0838 211/103
2008/0310910 A1 * 12/2008 Chick ..... E04G 1/20 403/49
2009/0051172 A1 * 2/2009 Yu ..... E05B 65/1006 292/198
2010/0089697 A1 * 4/2010 Kreller ..... E04G 5/14 182/113
2011/0088973 A1 * 4/2011 Shih ..... E04G 5/10 182/115
2014/0144006 A1 * 5/2014 Ashouri ..... E06C 7/50 29/525.08
2014/0252834 A1 * 9/2014 Line ..... B60N 2/36 297/378.14
2014/0299413 A1 * 10/2014 Hayman ..... E04G 7/32 182/186.8
2015/0075910 A1 * 3/2015 Thacker ..... E04G 5/04 182/229
2018/0112420 A1 * 4/2018 Hayman ..... E04G 5/145
2018/0142480 A1 * 5/2018 Mikic ..... E04G 3/20
2018/0202230 A1 * 7/2018 Wells ..... E06C 7/185

* cited by examiner

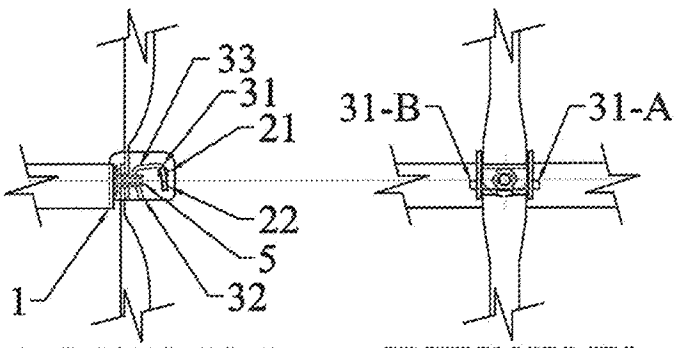
SECTION "B"-"B"
FIG. 12-C
SECTION "A"-"A"
FIG. 12-B
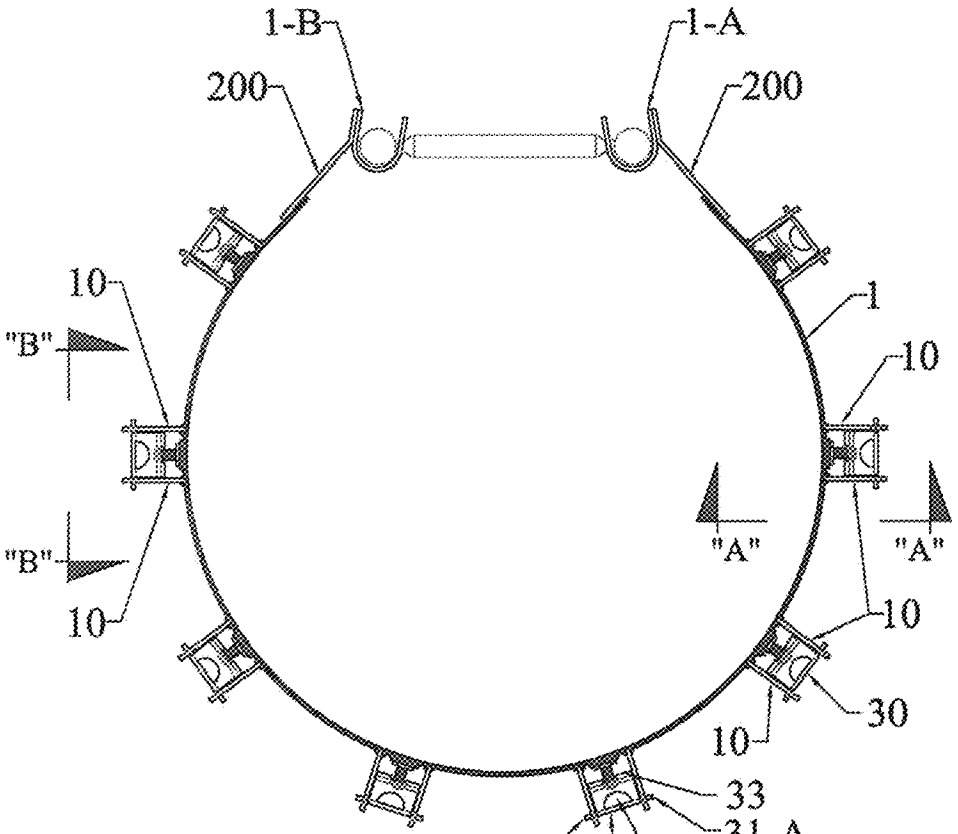
TOP VIEW- FLIP LOCK ASSEMBLY
FIG.12-A

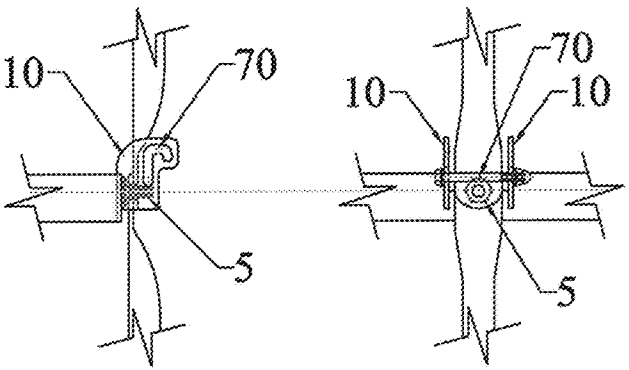
SECTION "B"-"B"
FIG. 13-C
SECTION "A"-"A"
FIG. 13-B
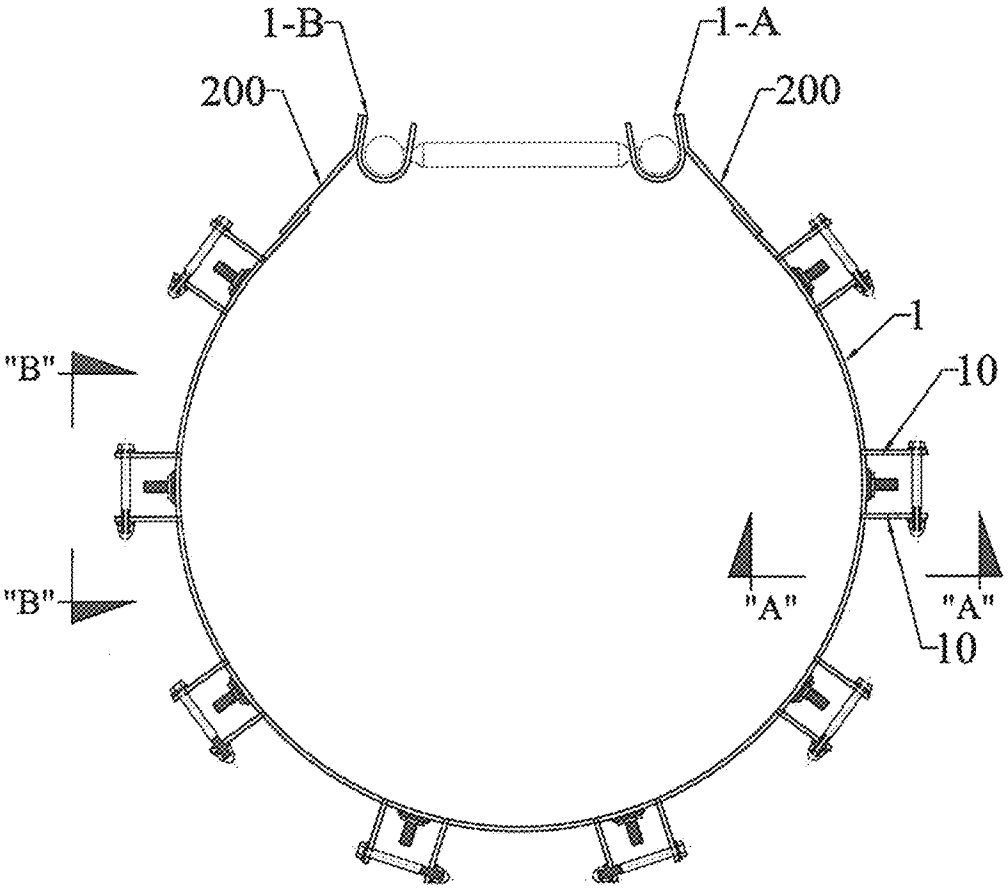
TOP VIEW- J SHAPED SLOT ASSEMBLY
FIG.13-A

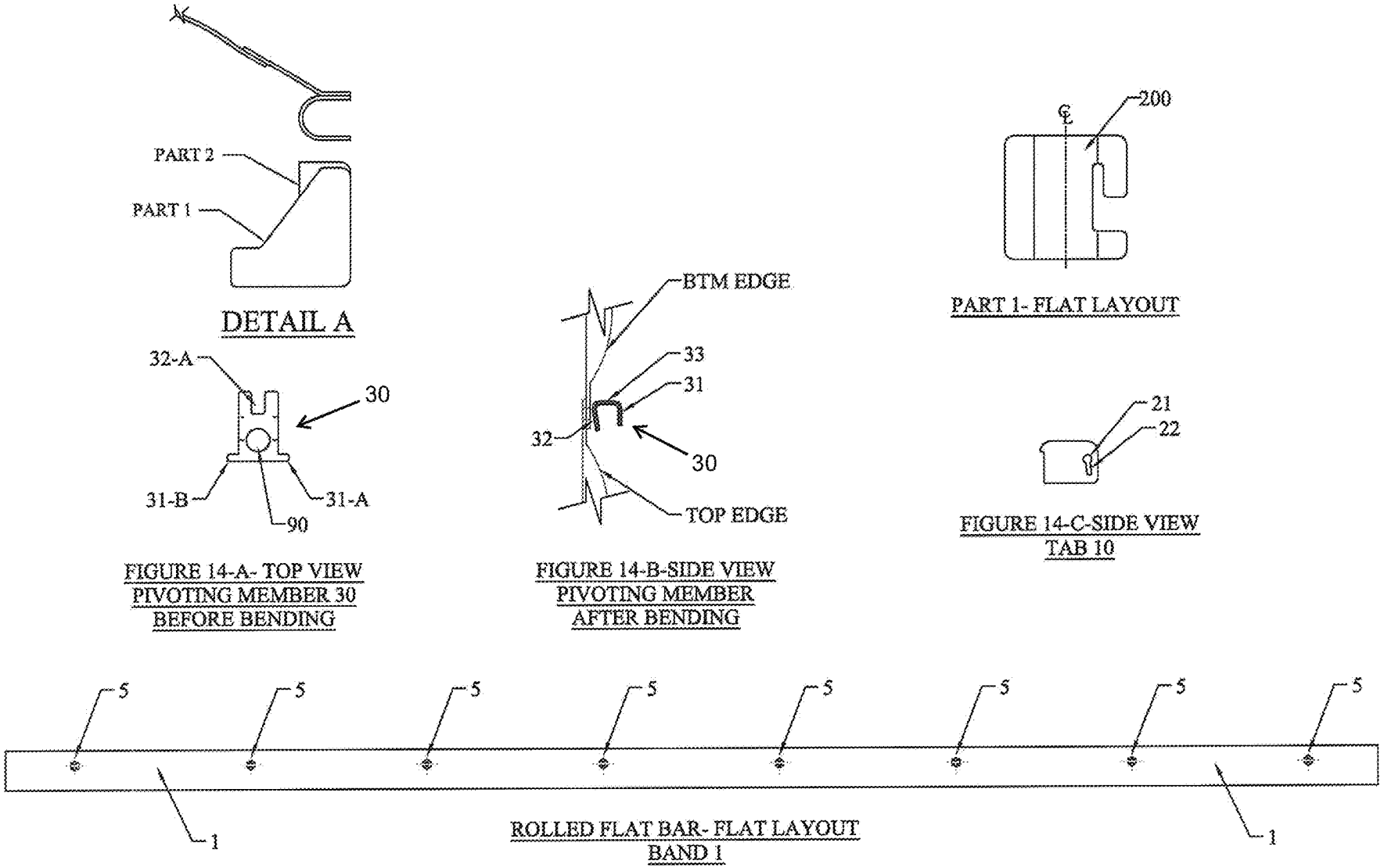
200
℄
PART 1- FLAT LAYOUT
21
22
FIGURE 14-C-SIDE VIEW
TAB 10
BTM EDGE
33
31
30
TOP EDGE
32
FIGURE 14-B-SIDE VIEW
PIVOTING MEMBER
AFTER BENDING
PART 2
PART 1
DETAIL A
30
31-A
90
32-A
31-B
FIGURE 14-A- TOP VIEW
PIVOTING MEMBER 30
BEFORE BENDING
5
1
ROLLED FLAT BAR- FLAT LAYOUT
BAND 1

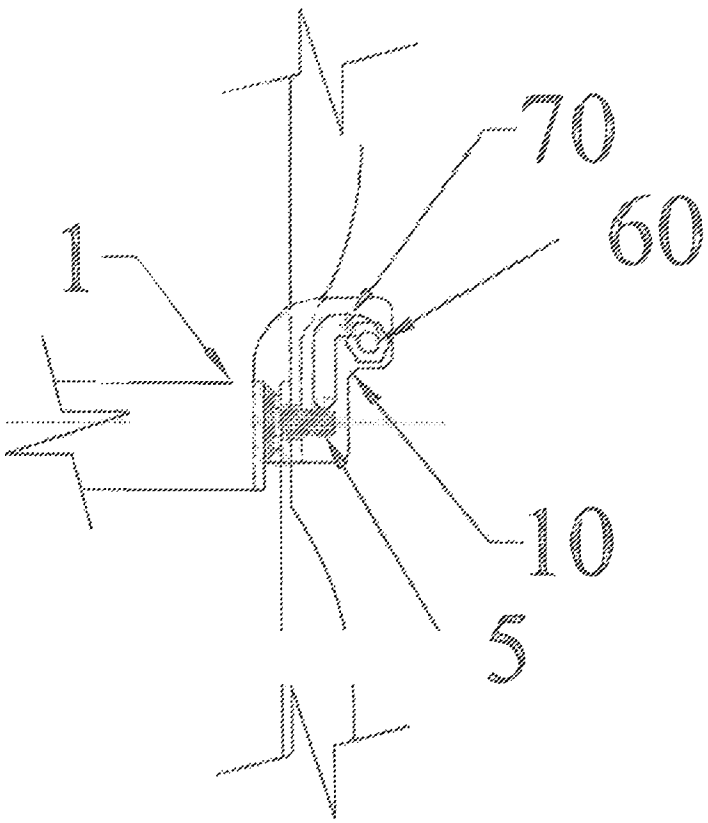
OPEN POSITION
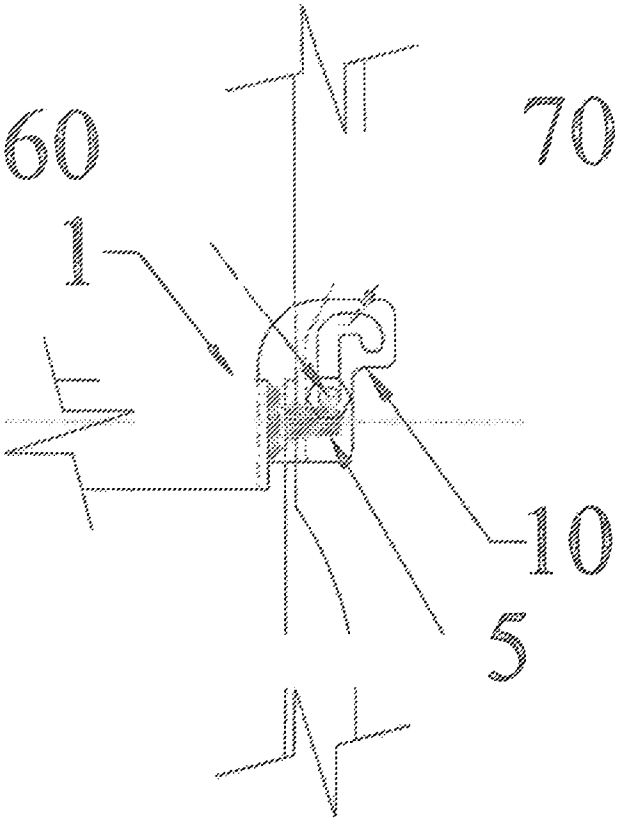
CLOSED POSITION
FIG. 15

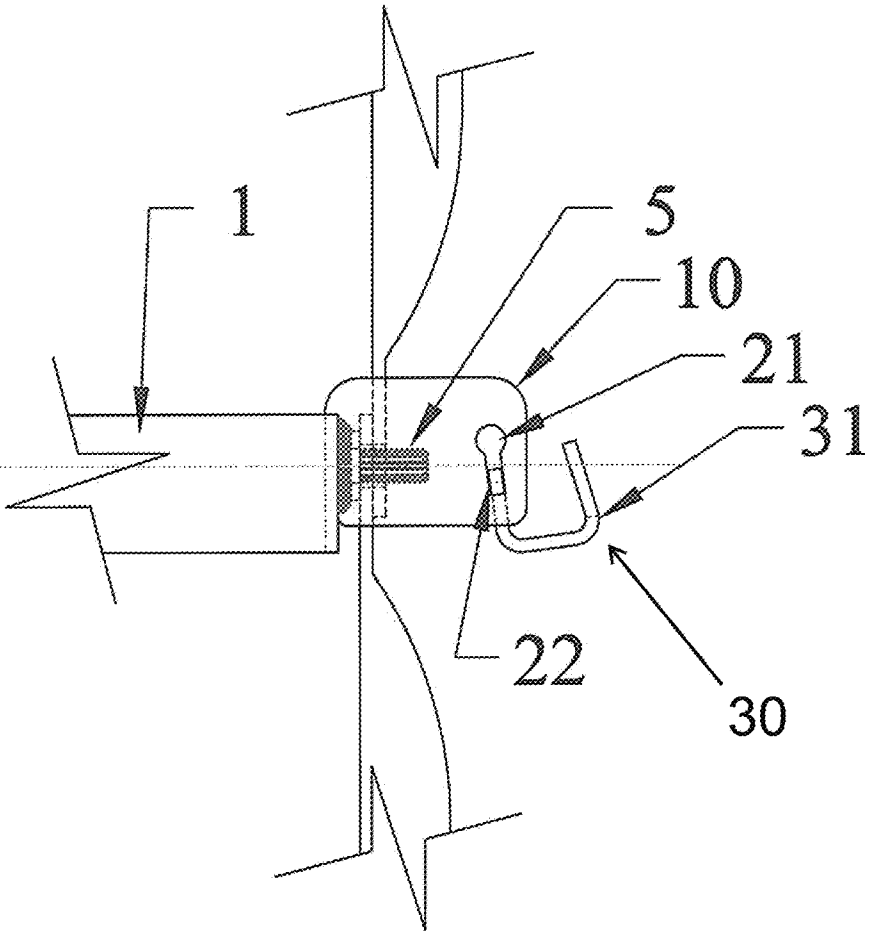
OPEN POSITION
FIG. 16-B
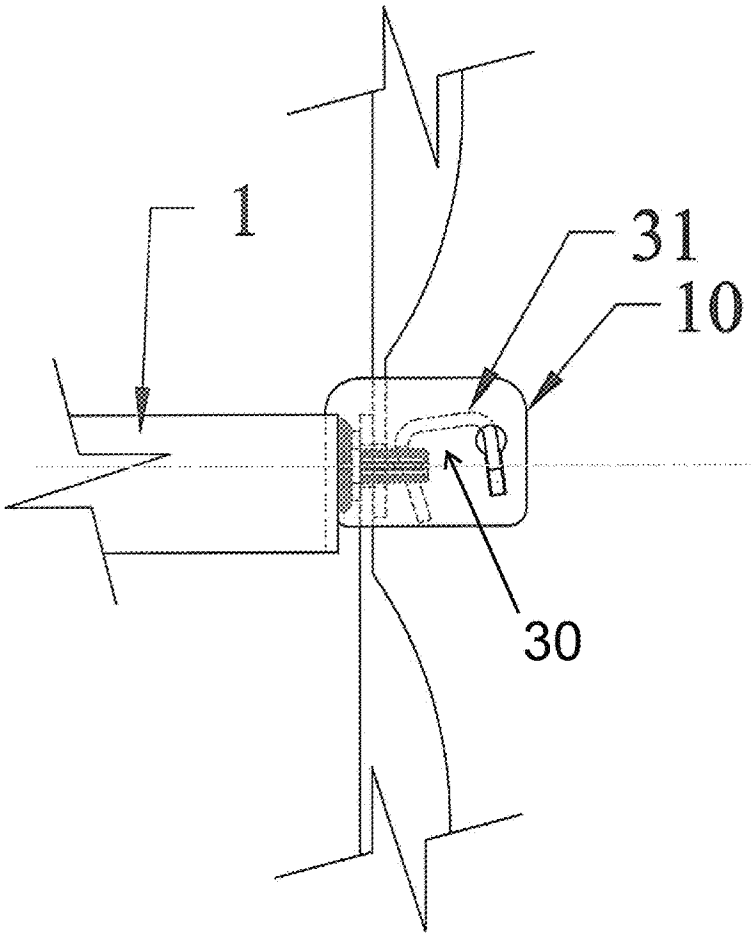
CLOSED POSITION
FIG. 16-A

LADDER HOOP

CROSS-REFERENCE TO RELATED APPLICATION

This application claims the priority benefit of U.S. provisional application No. 62/368,680 filed on Jul. 29, 2016, which is hereby incorporated by reference.

BACKGROUND OF THE INVENTION

Scaffolding is used to build temporary elevated work platforms. Scaffold structures consists of a supporting scaffold frame, on which the elevated deck or platform will rest. The scaffold frame generally consists of vertical scaffold members joined to horizontal scaffold members, such as shown in FIGS. 5-8. Since the work deck or work surface is elevated, workers generally have to climb the scaffold structure to access the elevated work surface. To assist, a scaffold structure may have a scaffold ladder 500 attached to the scaffold frame, generally attached to the outside of the scaffold frame (e.g., attached on the outer perimeter of the scaffold frame). To protect workers using the scaffold ladder, a scaffold ladder cage 1000 may be constructed to enclose the climbing path of a worker. An example of such a cage 1000 is shown in FIG. 1, and FIGS. 5-8.

As depicted, a scaffold cage 1000 is constructed from a series of spaced apart open cage rings or hoops 1 (almost "circular" shaped rings that have an opening in the ring sized to accommodate a scaffold ladder 500 between the ends of the ring). The open ring or hoop 1 has two terminating ends 1A and 1B, to which a clamp or other connector (such as slotted connector 200) is attached, so that the open end of the ring or hoop can be coupled to a scaffold ladder 500. The hoop or ring has an outer facing surface and an inner facing surface, and a top and a bottom. The hoop or ring can be a tube or a flat bar shaped into a circular ring. "Circular" shaped includes a hoop composed of multiple sides, such as the 7-sided hoop shown in FIG. 3.

Between adjacent rings 1 are positioned a series of vertical slats 100, connecting the adjacent open cage rings 1. For instance, on a ladder cage 1000 where the open rings have a diameter of about 30 inches, slats may be joined to the ring about every 10 inches on the ring circumference. The open cage rings or hoops 1 generally attached to the ladder 500, such as attached to the ladder rails or rungs, or both, using clamps or connectors, such as slotted connector 200. Open rings 1 will be spaced apart, for instance, every 2 or 4 feet. The combination of the hoops and slats 100 create a cage 1000 that surrounds the ladder 500, such as shown in FIGS. 5-10.

One embodiment of an open cage ring is shown in FIG. 4. As shown, the hoop 1 is "circular" shaped, and has a series of spaced apart threaded studs 5 positioned on the outer facing surface (which can be bolts welded to the hoop) fixedly attached to the outer perimeter of the ring 1, and extending outwardly from the outer facing surface of the ring 1. A wing nut 16 can be threaded onto each threadable stud.

The slats or braces 100 used with the open cage hoop of FIG. 4 are generally round tubular members with flattened terminating ends shown in FIGS. 10 and 11. Each terminating end of the brace or slat 100 can be flattened, and the flattened end can have a longtitudinal center slot, or an opening through the flattened end as shown in FIGS. 10 and 11, to allow the flattened end of the brace 100 to slide over a stud 5 on the hoop 1. Instead of tubular members, the slats or braces may be elongated plates, or other structure.

One method of assembly of a ladder cage 1000 using separate cage rings or hoops 1 with removable slats 100 is as follows (working from the bottom of the ladder to the top of the ladder):

Couple a first ring or hoop 1 to the ladder 500. Position a second ring 1 on the ladder 500 above the first ring 1. For each aligned pairs of studs on the two adjacent ladder hoops 1, install a slat 100 over these aligned studs 5. Place a wing nut 16 on the bottom most stud 5 and tighten the nut down. This process is repeated for each pair of aligned studs on adjacent hoops. At this point, slats 100 are in position between the first and second hoops 1. The operator then couples a third hoop 1 to the ladder 500, positioned above the second hoop. The operator then moves to the second hoop, and places slats 100 or rungs between the second and third hoops aligned studs 5, placing wing nuts 16 over the threaded studs on the second hoop. On intermediary hoops, say hoop x, each stud will be coupled to two slats—a slat between hoop x−1 and x, and a slat between hoops x and x+1. The process repeats until the operator installs the final top hoop, and threads wing nuts 16 over the installed rungs coupled to the top hoop and the hoop immediately below the top hoop. This process is fairly arduous, as the operator is working from the ladder and has to reach around the installed slats to thread on the wing nuts. The process is slow, and cumbersome, and wing nuts can be difficult to thread onto the studs, as the studs or the wing nuts can be damaged in the field. A better method and system is needed.

DESCRIPTION OF THE FIGURES

FIG. 12A is a top elevation view of a hoop with one embodiment of a pivoting attachment system installed thereon.

FIG. 12B is a side elevation view of the pivoting attachment system in FIG. 12A.

FIG. 12C is a top elevation view of the pivoting attachment system of FIG. 12A.

FIG. 13A is a top elevation view of a hoop with one embodiment of a slidable attachment system installed thereon.

FIG. 13B is a side elevation view of the slidable attachment system in FIG. 13A.

FIG. 13C is a top elevation view of the slidable attachment system of FIG. 13A.

FIG. 14A is a top view of one embodiment of the pivoting member constructed of a flat plate metal before bending into a U shape.

FIG. 14B is a side view of the pivoting member of FIG. 14A after bending into a U shape.

FIG. 14C is a side view of the one embodiment of the tab used in the pivoting attachment member system.

FIG. 15 a perspective view of two embodiments of channel shapes for the slidable attachment system.

FIG. 16A is a side elevation ghosted view of one embodiment of a pivoting attachment system in a closed position.

FIG. 16B is a side elevation ghosted view of one embodiment of a pivoting attachment system in an open position.

A DESCRIPTION OF THE PREFERRED SYSTEM

Figure 1:
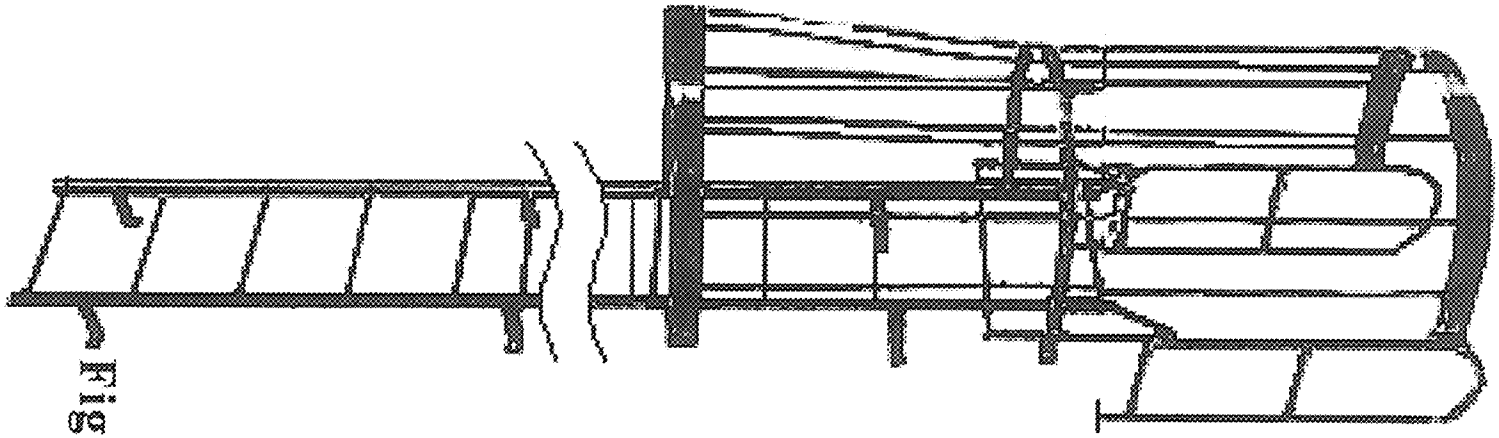
FIG. 1 is a depiction of one embodiment of a ladder cage.
Figure 2:
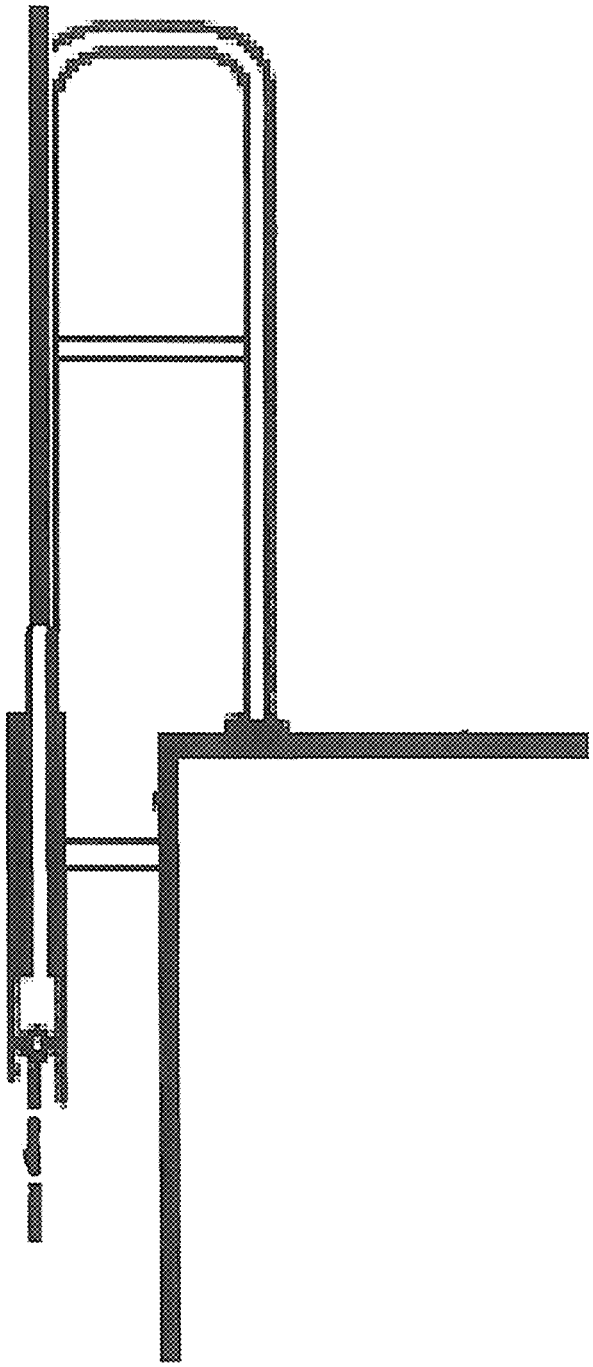
FIG. 2 is a depiction on one embodiment of a ladder top.
Figure 3:
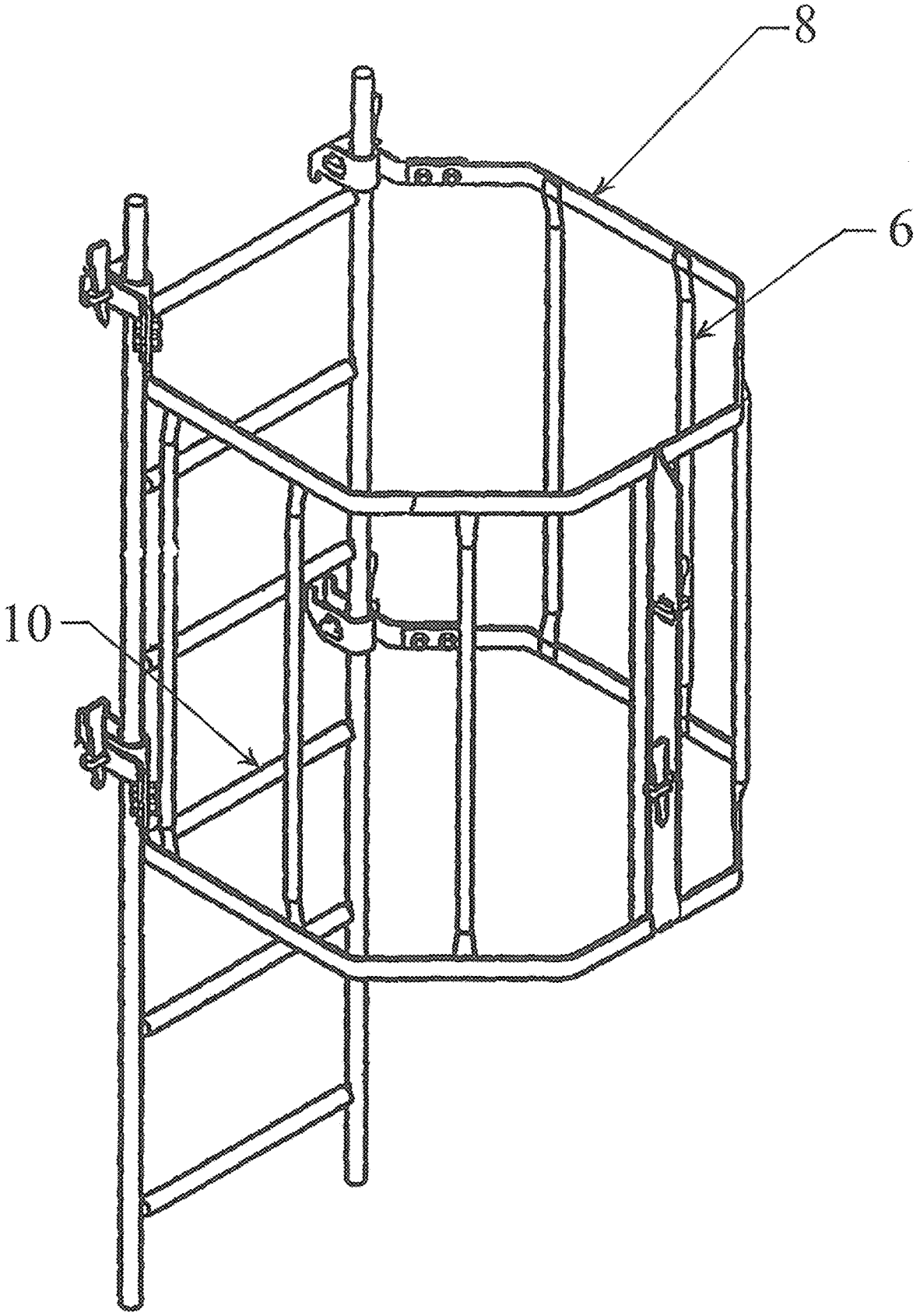
FIG. 3 is a perspective view on one embodiment of a prior art ladder cage.
Figure 4:
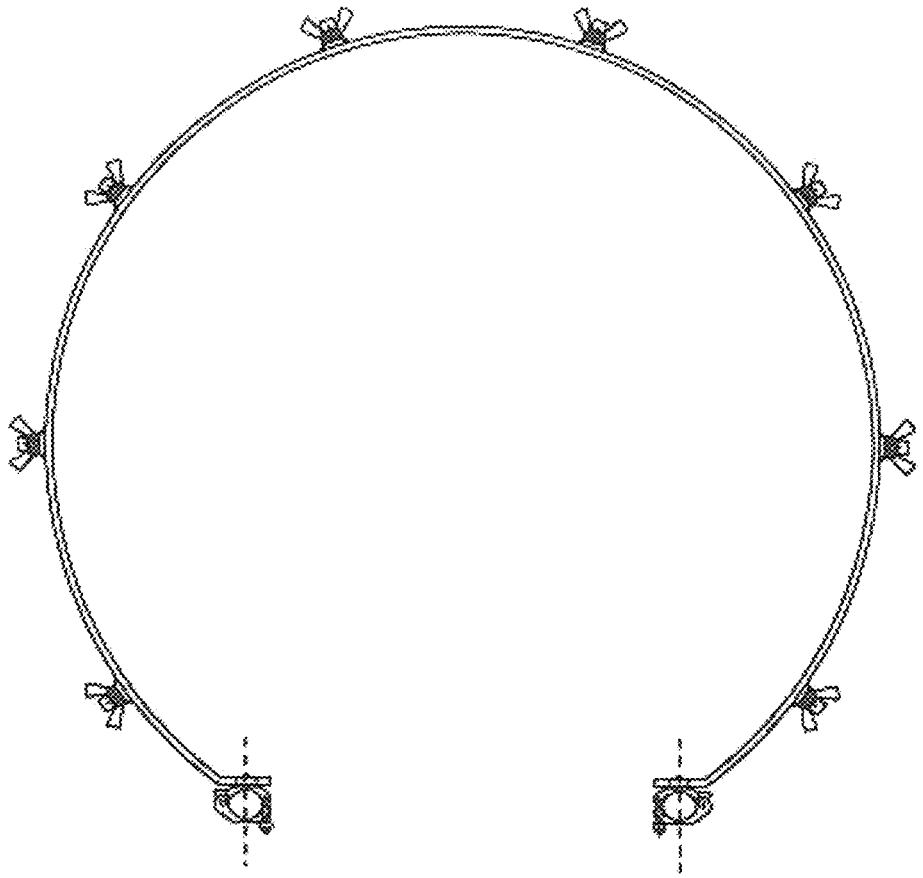
FIG. 4 is a top view of an existing ladder hoop.
Figure 5:
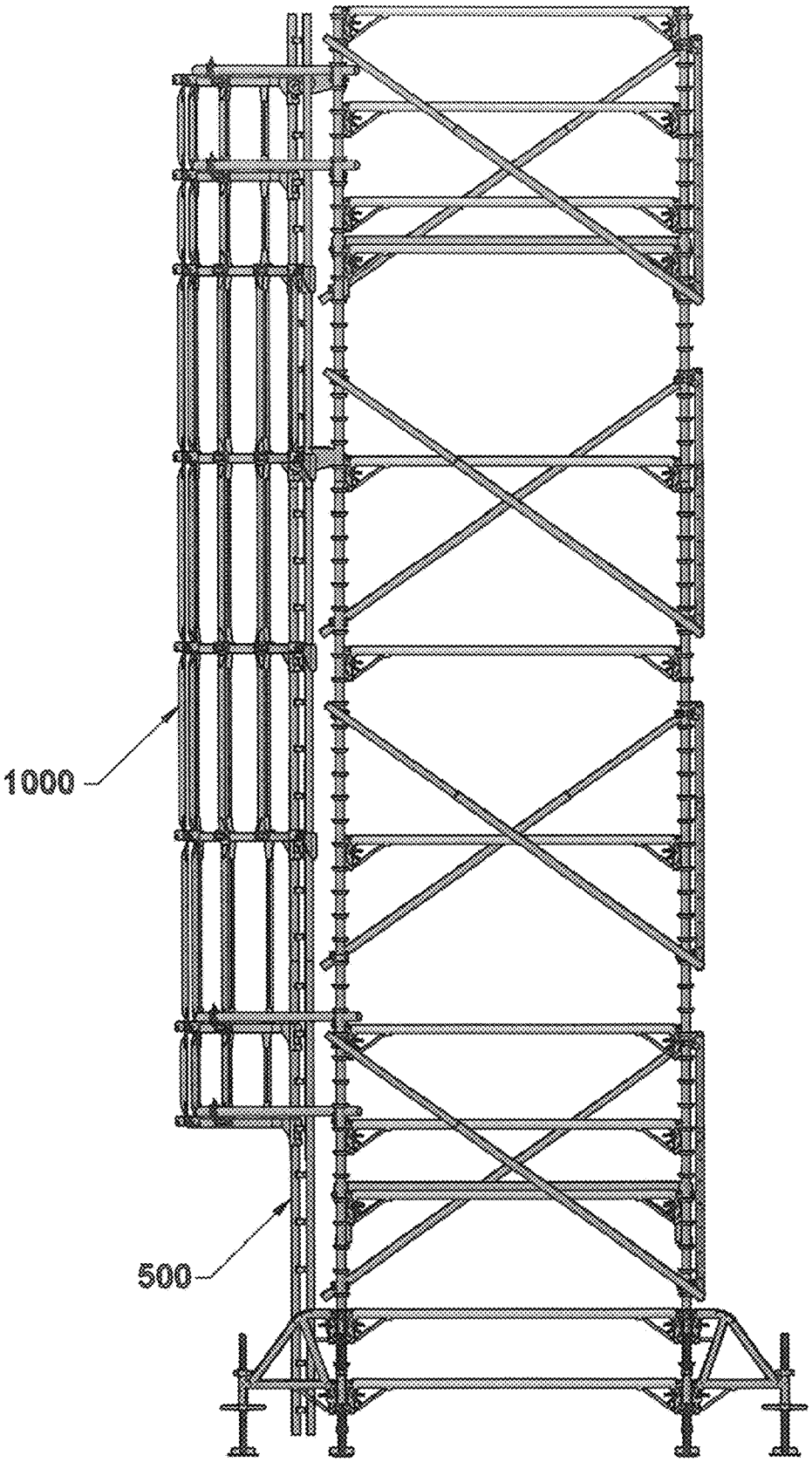
FIG. 5 is a side elevation view of a scaffold structure with a ladder cage installed.
Figure 6:
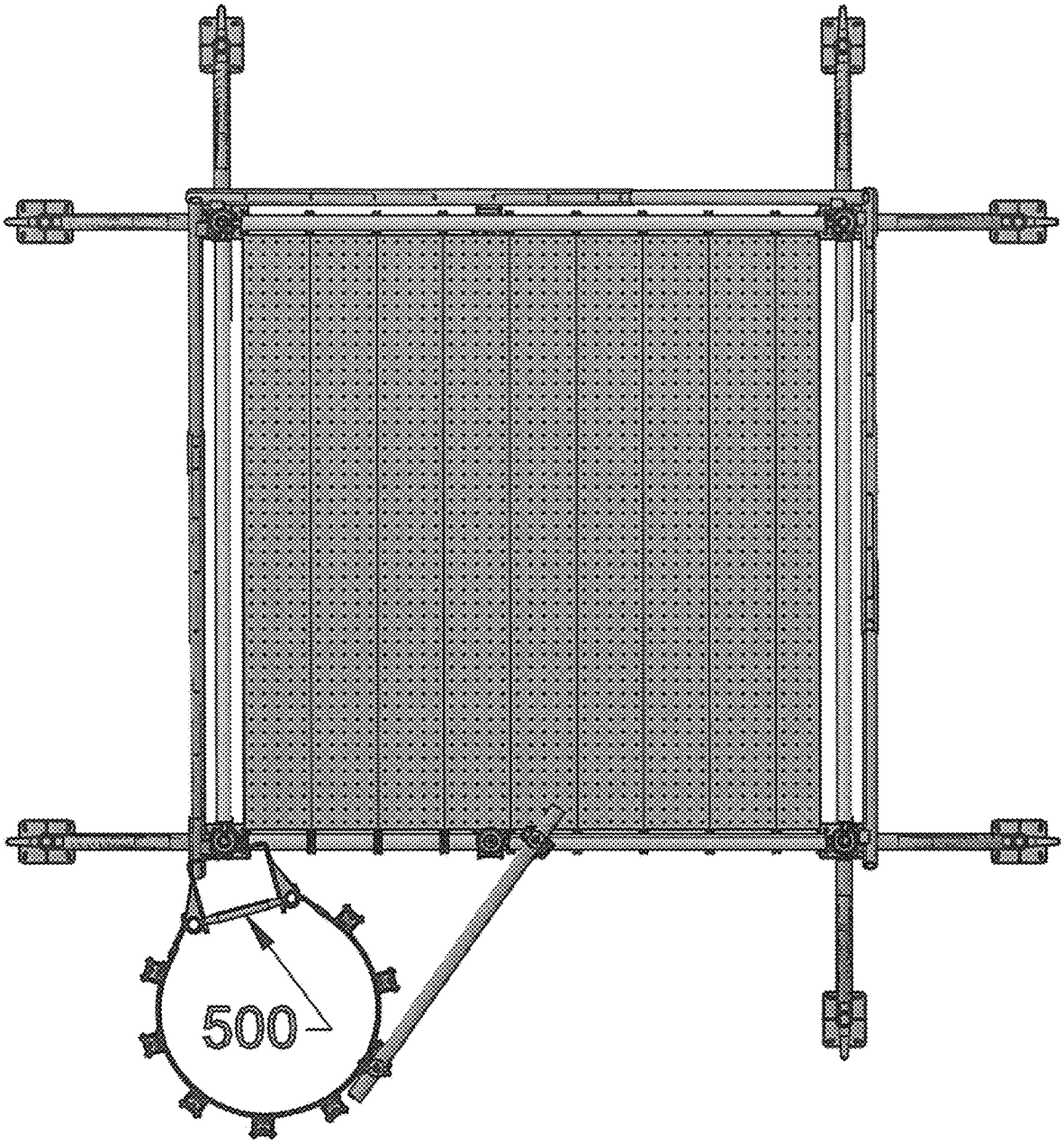
FIG. 6 is a top elevation view of a scaffold structure with a ladder cage installed.
Figure 7:
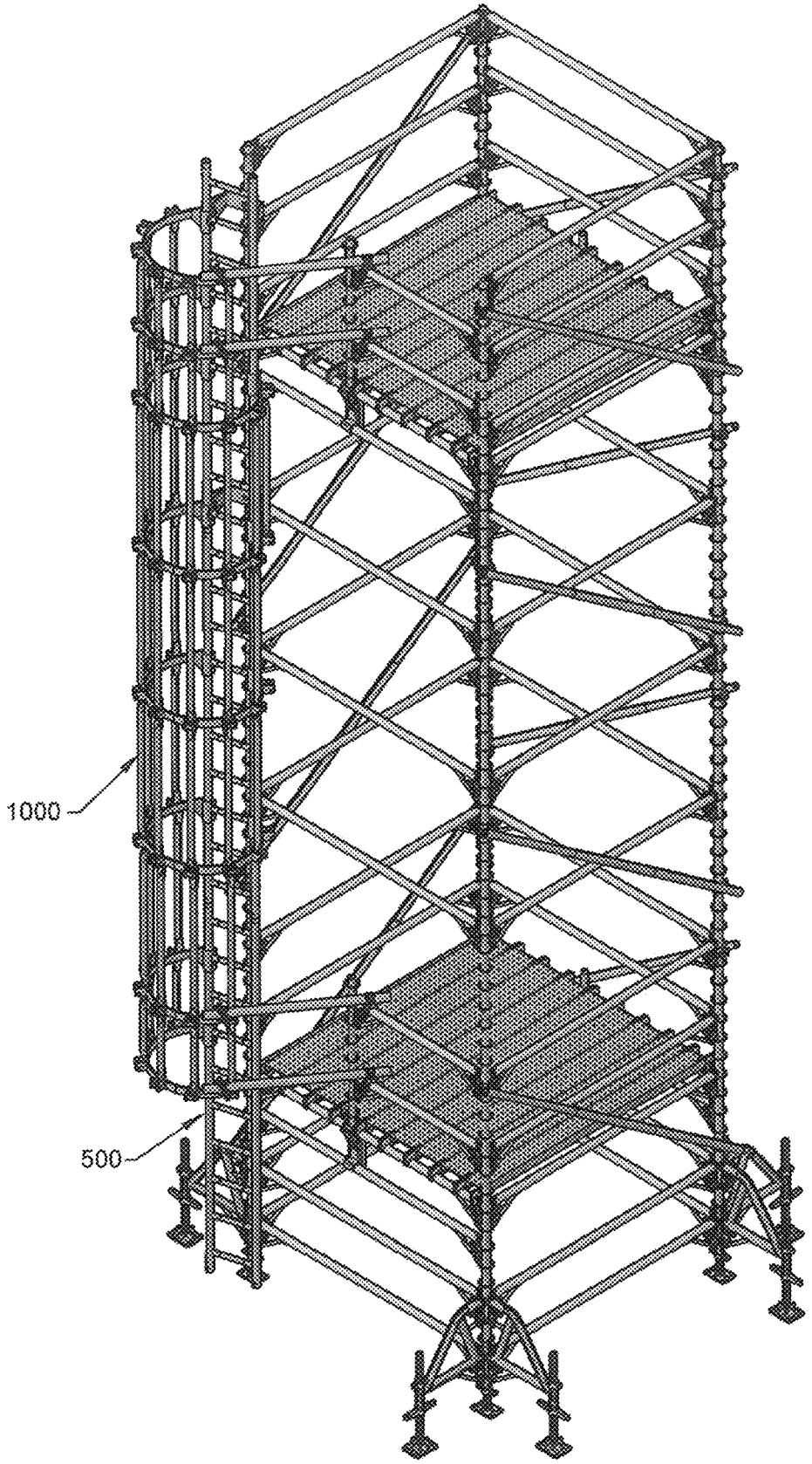
FIG. 7 is a perspective view of a scaffold structure with a ladder cage installed.
Figure 8:
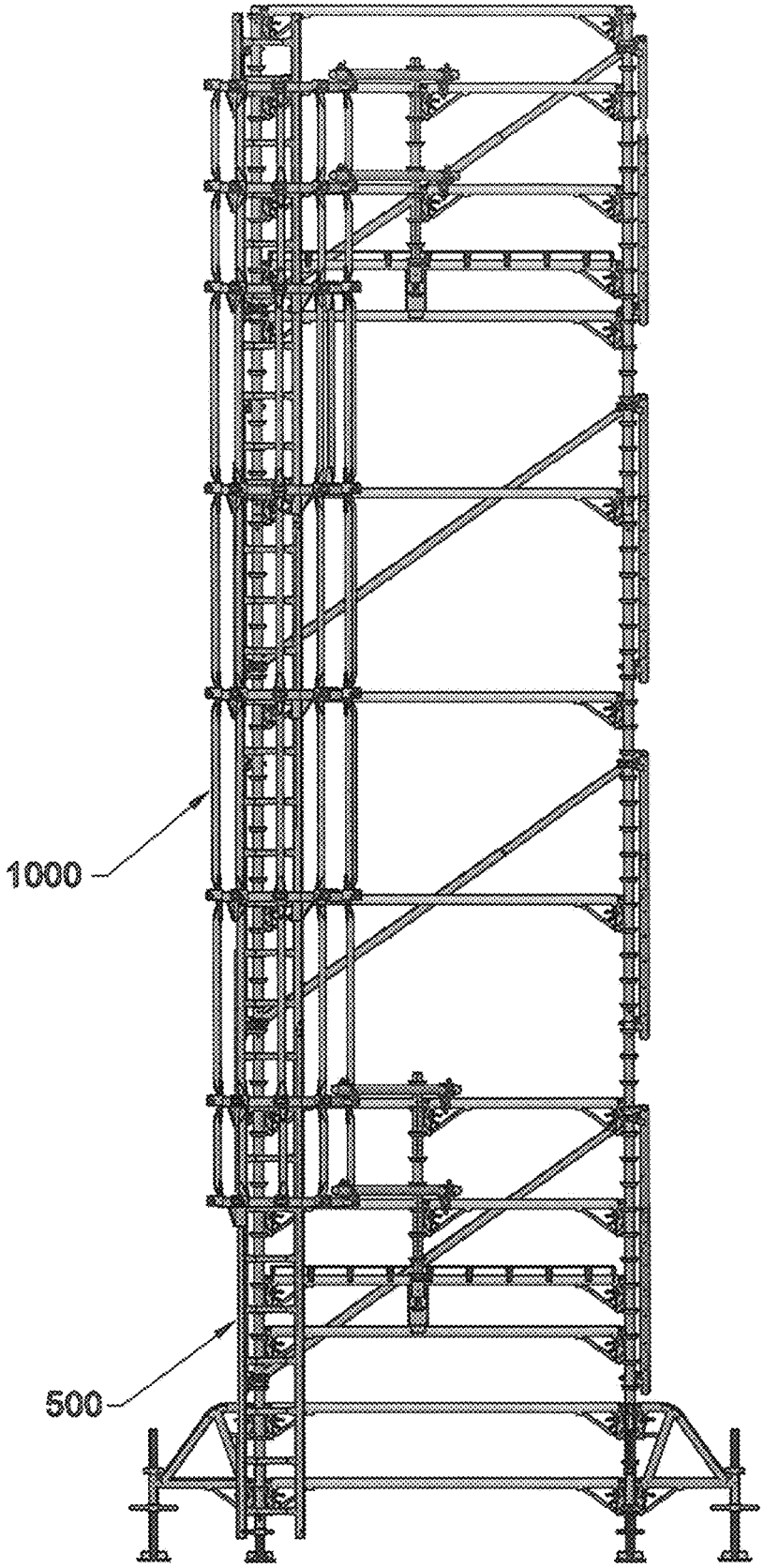
FIG. 8 is a front elevation view of a scaffold structure with a ladder cage installed.
Figure 9A:
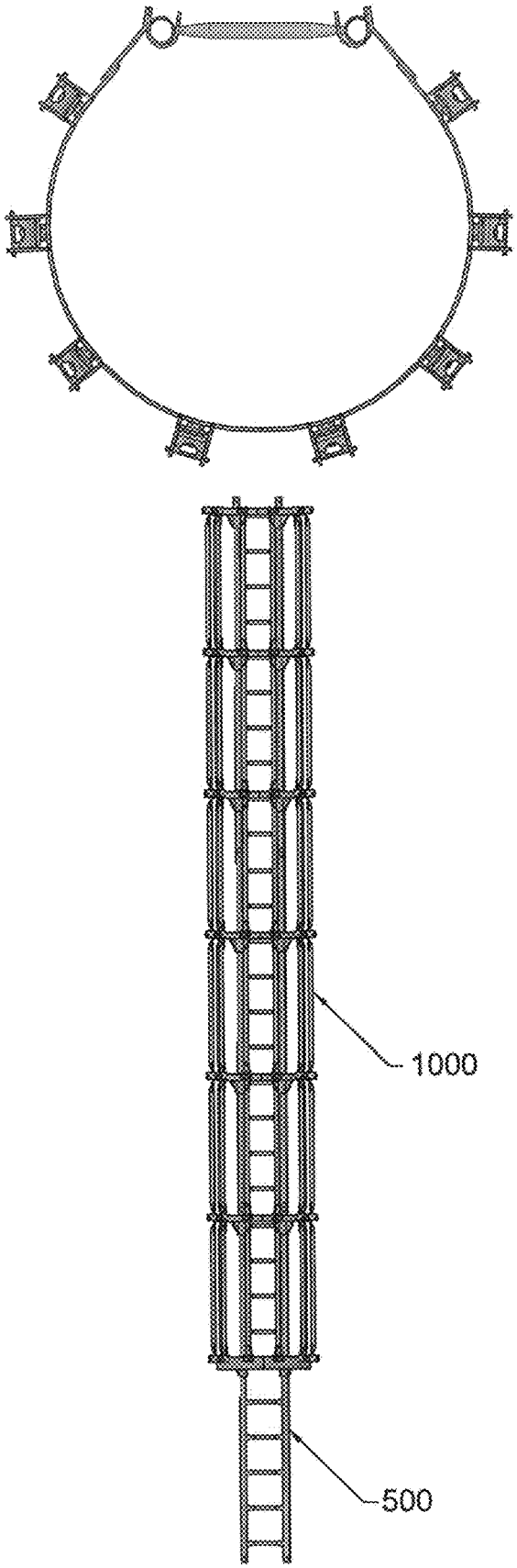
FIG. 9A is a front elevation view of a ladder cage.
Figure 9B:
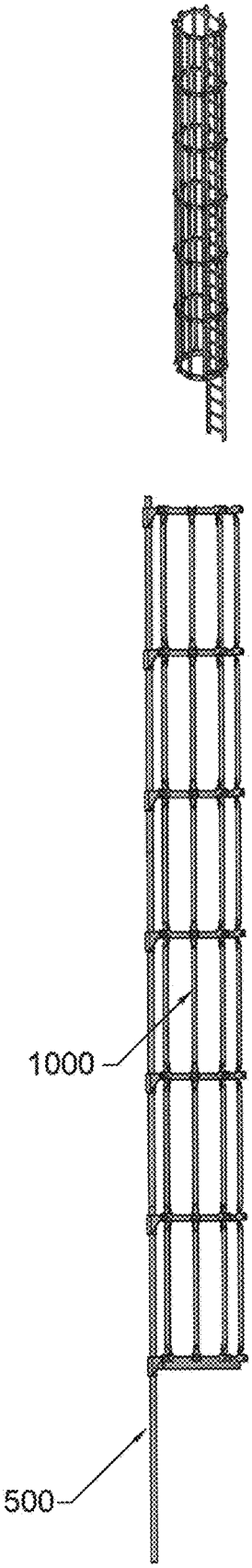
FIG. 9B is a side elevation view of the ladder cage of FIG. 9A.
Figure 10:
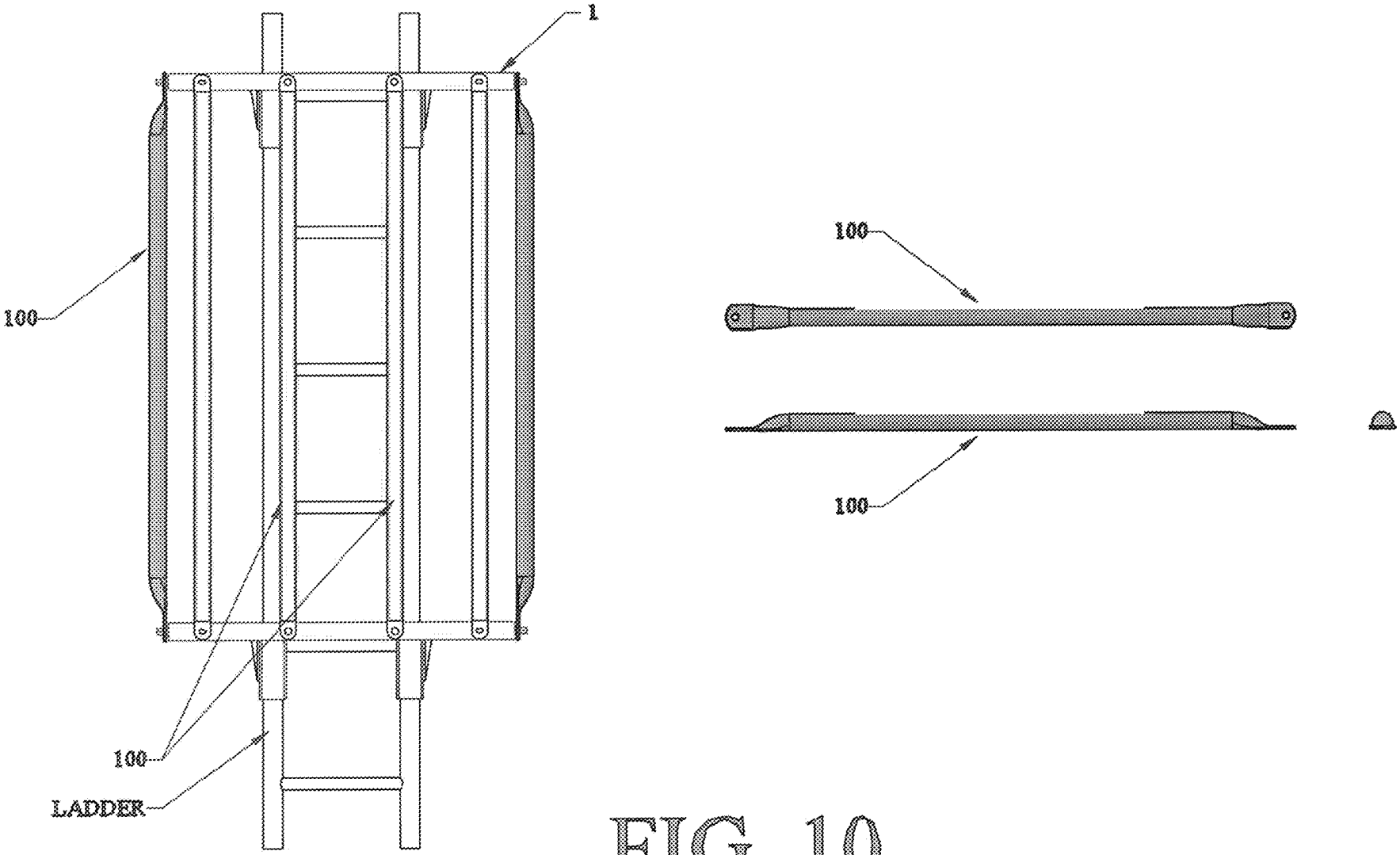
FIG. 10 are views of one embodiment of a slat or brace.
Figure 11:
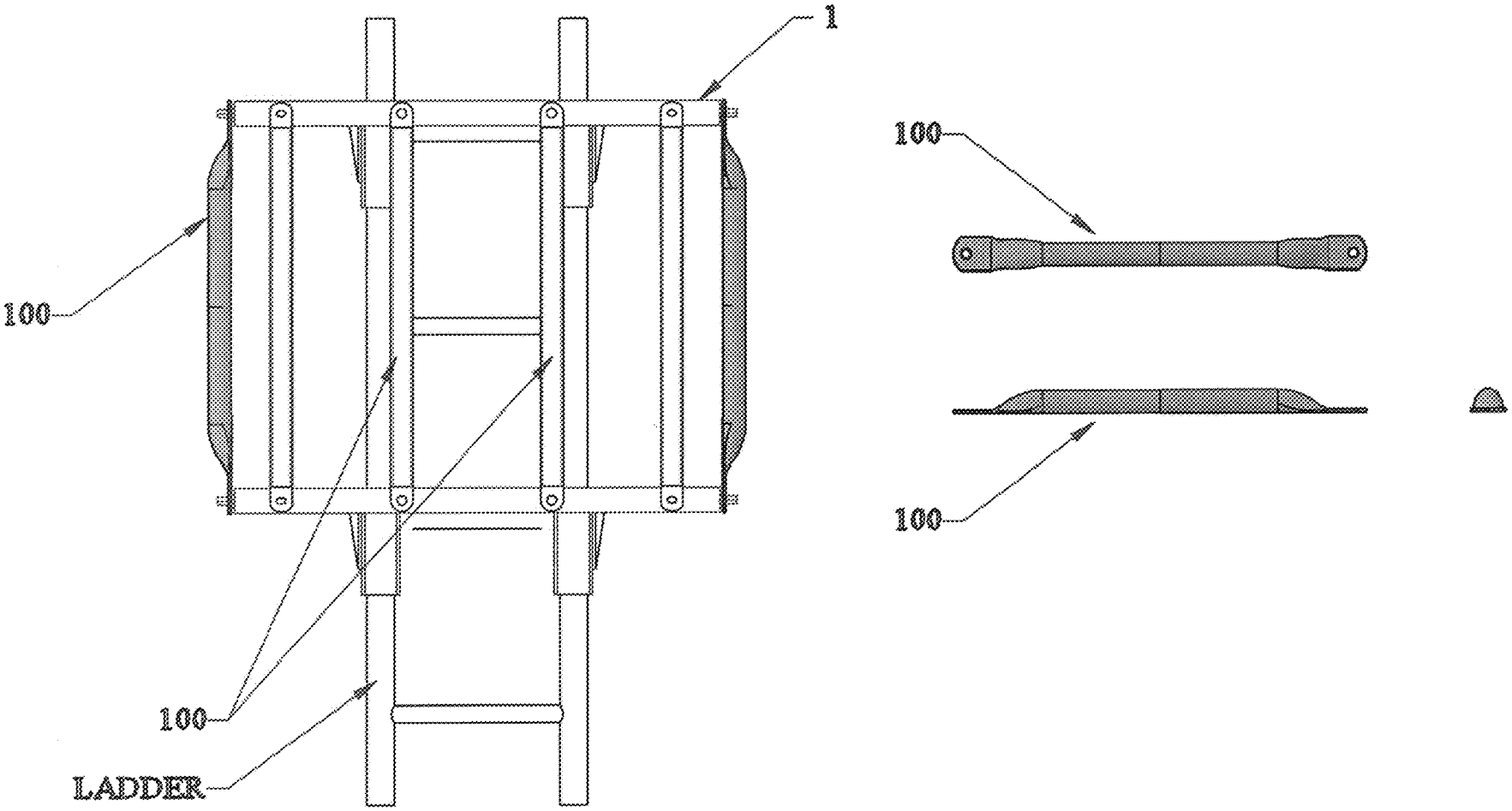
FIG. 11 are views of another embodiment of a slat or brace.

In the preferred system, each wing nut attachment system is replaced with a pivoting attachment system, where each pivoting attachment system is fixedly installed on the ladder hoop 1 around each stud 5. As shown in FIG. 12A, each preferred pivoting attachment system includes two vertically orientated (e.g. extending between the top and the bottom of the hoop) substantially parallel tabs 10 extending outwardly on opposing sides of a stud 5. In the present system, the stud 5 does not have to be threaded, but for retro-fitting of existing hoops, the studs 5 may be threaded. In each tab 10, near the outer edge of the tab, is a thru opening 20. As shown, the preferred thru opening 20 has two parts: a top circular shaped opening 21, and a bottom vertically oriented slot shaped opening 22, whose functionality will be later described. Positioned in the gap between the tabs 10 is a pivoting member 30. As shown, the preferred shape of the pivoting member 30 is generally a "U" shaped member, but other shapes are within the scope of the invention, such as an "L" shaped member, a semicircular shaped plate, or other geometries. The U shaped member is generally formed for plate steel that is bended into the desired shape, such as shown in FIGS. 14A and 14B.

The "U" shaped plate member has two legs 31 and 32, and a portion 33 connecting the legs 31 and 32 (see FIGS. 14A and 14B). As shown leg 31 has a top and bottom edge, as does leg 32. Connecting portion 33 connects the legs 31 and 32, preferably at or near their bottom edge. The top portion of leg 31 is slightly longer than the bottom portion, creating two "ears" 31A and 31B on the top portion of leg 31. In an assembled pivoting attachment system, each ear 31A and 31B extends though one of the thru openings in the opposing tabs 10, thereby supporting the pivoting member 30 in the attachment system. The leg 32 has a center slot 32A from the top edge to near the bottom edge, to accommodate the stud 5 therein, as later described. Preferably, positioned in the connection portion 33, near the connection with the bottom edge of leg 31, is an opening 90. As shown, the opening 90 extends onto the leg 31 after the plate is bent.

As shown in FIG. 12B, when the ears 31A and 31B are positioned in the circular shaped portion 21 of thru openings 20, the pivoting member 30 is pivotable or rotatable in the circular shaped opening 21 almost 270+ degrees. When the ears 31A and 31*b* are positioned in the slot shaped portion 22 of thru openings 22, the ability of the pivoting member 30 to rotate is limited, for instance, to 0-10 degrees.

When pivotable, the pivoting member 30 rotates from a closed position or lacked position (where leg 32 is proximal to the stud 5, whereby stud 5 is positioned in center slot 32A of leg 32), (see FIG. 16A) to an open or unlocked position (see FIG. 16B). In the closed position, the ears 31A and 31B of the leg 31 will generally be aligned with the slots 22 in the thru opening, thereby allowing the ears 31A and 31B to fall into the respective slots 22 on opposing tabs 10, locking the pivoting member 30 in the closed position. In the closed position, a gap is present between the top ends of legs 31 and 32 and the hoop 1 as depicted in FIG. 12B. The gap should be sufficient to allow two slats 100 (an upward and downward orientated slat 100) to be mounted on the stud 5 between the hoop 1 and a closed pivoting member 30.

An open position of the pivoting member 30 is any position of the pivoting member 30 where both legs 31 and 32 are offset from the end of the stub 5 sufficiently to allow a slat 100, mounted on the stud 5, to be removed from the stud 5. For instance, when the pivotable member is rotated about 70 degrees from the closed position to about 245 degrees from the closed position (or further, if opening 90 extends onto leg 32 as shown), clearance is sufficient to remove a mounted slat 100.

To rotate the pivoting member 30 from a closed position, if locked closed, the pivoting member must first be raised so that the ears 31A and 31B clear the slot 22, and the ears are located in circular shaped opening 21. As described, when the pivoting member 30 is rotated by an operator from a closed position toward an open position, the weight and center of gravity of the pivotable member 30, once rotated past about 50 degrees from the closed position, will further rotate open on its own accord by gravity. Generally, this natural rotation will result in the pivoting member 30 rotating sufficiently (about 180 degrees) from the closed position until the ears 31A and 31B naturally rotate into alignment with the vertical slots 22 on opposing tabs 10, and then the ears fall into the slots 22, thereby locking the pivoting member 30 in an open position. To allow the pivoting member to rotate from the locked open position, the pivoting member must first be raised so that the ears 31A and 31B clear the slot 22 and are located in circular shaped opening 21.

The opening 90 in the connector member 33 is to allow an operator to insert a tool (such as a screwdriver) into the slot 90 to assist in moving or rotating the pivoting member 30 in the event the member is jammed or partially frozen in the closed position.

As described, the pivoting attachment system is used to deploy a caged ladder as follows, (working from the bottom of the ladder to the top of the ladder):

Couple a first ring or hoop 1 to a scaffold ladder 500, with the hoop 1 orientated on the ladder so that the slot openings 22 are located below the circular openings 21. Position the pivoting members 30 in the open position. Couple a second ring or hoop 1 to the ladder 500 above the first hoop, similarly orientated, and position the pivoting members 30 on the second hoop 1 in the open position. For each aligned pairs of studs 5 on the two adjacent ladder hoops 1, install a slat 100 over these aligned stud 5*s*. Rotate the pivoting member 30 on that stud 5 on the lower hoop 1 from the open position to a closed position. This process is repeated for each pair of aligned studs 5 on adjacent hoops 1. At this point, slats 100 are in position between the first and second hoops. The operator then couples a third hoop to the ladder 500, positioned above the second hoop. The operator then moves to the second hoop, and places slats 100 between the aligned studs 5 between the second and third hoops, again rotating the pivotable members on the second hoop from an open position to a closed position, locking the slats 100 on the second hoop in place. This process is repeated with a $4^{th}$ hoop, etc. until the operator installs the final top hoop, and the respective slats 100 attached between the top hoop and the hoop located below the top hook, and the pivoting members 30 on the top hoop pivoted to the closed position.

As described, the pivoting attachment system is easy to use and deploy, and permanently attached to each hoop. Variations in the system are possible, for instance, using an L shaped member (elimination of leg 32), or a semicircular or a quarter circular shaped attachment member, or elimination of the slot shaped opening 22 in the legs, or elimination of the opening 90 in the connecting member 33.

Instead of a pivoting attachment member, a slidable member may be used, such as shown in FIG. 14, where a movable pin 60 may be used, where the pin 60 is mounted in shaped channels 70 in the tabs 10, such as an inverted "J" shaped or "U" shaped channel, as shown in FIGS. 14 and 15. The pin 60 slides in the channels 70 on opposing tabs from a closed to an open position.

As described, the system is a ladder hoop that includes a series of studs on the exterior facing surface of the ladder hoop. On opposing sides of each stud are tabs that extend outwardly. The opposing tabs are used to mount either a pivoting or slidable member, where the pivoting or slidable member pivots or slides between a locked position and an unlocked position, whereby in a locked position, the member prevents a slat mounted on the stud from being removed, and in an unlocked position, a slat mounted on the stud may be removed.

The invention claimed is:

1. A ladder hoop comprising a hoop shaped member having an inner facing surface and an outer facing surface, and a top and a bottom, said hoop having two terminating ends forming an opening there between, and each terminating end adapted to attach to a scaffold ladder, the hoop having a series of studs positioned on and extending outwardly from the outer facing surface;

each stud having an associated pair of tabs being vertically orientated on the ladder hoop and extending outwardly on said outer facing surface substantially parallel with the associated stud, where the associated stud is positioned between the associated pair of tabs;

for each pair of tabs, an associated member mounted on said tabs, said member movable on said tabs between an open position and a closed position, whereby in said closed position, said member blocks removal of a slat mounted on the stud positioned between the associated tabs, while in the open position, the member does not block removal of a slat mounted on the stud positioned between the associated tabs, and further does not block the mounting of a first slat from above the ladder hoop and a second slat from below the ladder hoop, with the stud positioned between the associated tabs where each of said members is a U shaped member pivotally mounted between the associated tabs wherein each of the members pivots on an axis extending between and intersecting the two associated tabs.

2. The ladder hoop of claim 1, wherein the U shaped member has a center lengthwise slot therein, sized to accommodate one of said studs on the ladder hoop.

3. The ladder hoop of claim 2, wherein said stud extends through said slot when said member is in said closed position.

4. A ladder hoop comprising a hoop shaped member having an inner facing surface and an outer facing surface, and atop and a bottom, said hoop having two terminating ends forming an opening there between, and each terminating end adapted to attach to a scaffold ladder, the hoop having a series of studs positioned on and extending outwardly from the outer facing surface; each stud having an associated pair of tabs vertically orientated on the ladder hoop and extending outwardly on said outer facing surface substantially parallel with the associated stud, where the associated stud is positioned between the associated pair of tabs;

for each pair of tabs, an associated member mounted on said tabs, said member movable on said tabs between an open position and a closed position, whereby in said closed position, said member blocks removal of a slat mounted on the stud positioned between the associated tabs, while in the open position, the member does not block removal of the slat mounted on the stud positioned between the associated tabs, and further does not block the mounting of a first slat from above the ladder hoop and a second slat from below the ladder hoop, with the stud positioned between the associated tabs;

where the moveable member is lockable into the closed position.

* * * * *